US005804346A

United States Patent [19]

Ohashi et al.

[11] Patent Number: 5,804,346

[45] Date of Patent: Sep. 8, 1998

[54] ELECTROPHOTOGRAPHIC PHOTORECEPTOR

[75] Inventors: Toyoshi Ohashi, Yokohama; Masayoshi Yabe, Ami-machi; Shinichi Suzuki, Yokohama, all of Japan

[73] Assignee: Mitsubishi Chemical Corporation, Tokyo, Japan

[21] Appl. No.: 833,520

[22] Filed: Apr. 7, 1997

[30] Foreign Application Priority Data

| | | | |
|---|---|---|---|
| Apr. 10, 1996 | [JP] | Japan | 8-088103 |
| Apr. 10, 1996 | [JP] | Japan | 8-088104 |
| Apr. 10, 1996 | [JP] | Japan | 8-088105 |

[51] Int. Cl.[6] ..... G03G 5/087

[52] U.S. Cl. ..... 430/78; 430/96

[58] Field of Search ..... 430/59, 78, 96

[56] References Cited

U.S. PATENT DOCUMENTS

| | | | |
|---|---|---|---|
| 5,190,839 | 3/1993 | Fujimaki et al. | 430/78 |
| 5,200,286 | 4/1993 | Yuichi et al. | 430/58 |
| 5,677,096 | 10/1997 | Suzuki | 430/78 |

FOREIGN PATENT DOCUMENTS

| | | |
|---|---|---|
| 0 430 630 | 6/1991 | European Pat. Off. . |
| 0 458 651 | 11/1991 | European Pat. Off. . |
| 0 560 311 | 9/1993 | European Pat. Off. . |
| 0 686 878 | 12/1995 | European Pat. Off. . |
| 1-169454 | 7/1989 | Japan . |
| 2-289658 | 11/1990 | Japan . |
| 5-289378 | 11/1993 | Japan . |
| 5-313387 | 11/1993 | Japan . |

OTHER PUBLICATIONS

Database WPI, Section Ch, Week 9405, Class A81, AN 94–040098, XP002036187 & JP 05 345 867 A (Konica Corp.), 27 Dec. 1993, Abstract.

Database WPI, Section Ch, Week 8130, Class A89, AN 81–54100D, XP002036188 & JP 56 067 854 A (Fujitsu Ltd.), 8 Jun. 1981, Abstract.

Database WPI, Section Ch, Week 9232, Class A23, AN 92–262050, XP002036189 & JP 04 174 857 A (Konica Corp.), 23 Jun. 1992, Abstract.

*Primary Examiner*—John Goodrow

*Attorney, Agent, or Firm*—Oblon, Spivak, McClelland, Maier & Neustadt, P.C.

[57] ABSTRACT

An electrophotographic photoreceptor for digital photo-input, having a threshold value in its photo-induced decay curve and having a photosensitive layer of titanylphthalocyanine dispersed in a binder resin provided on an electroconductive substrate, wherein the binder resin is a polycarbonate resin and the photosensitive layer contains a compound having a carboxyl group.

16 Claims, 4 Drawing Sheets

ELECTROPHOTOGRAPHIC PHOTORECEPTOR

Figure 1:
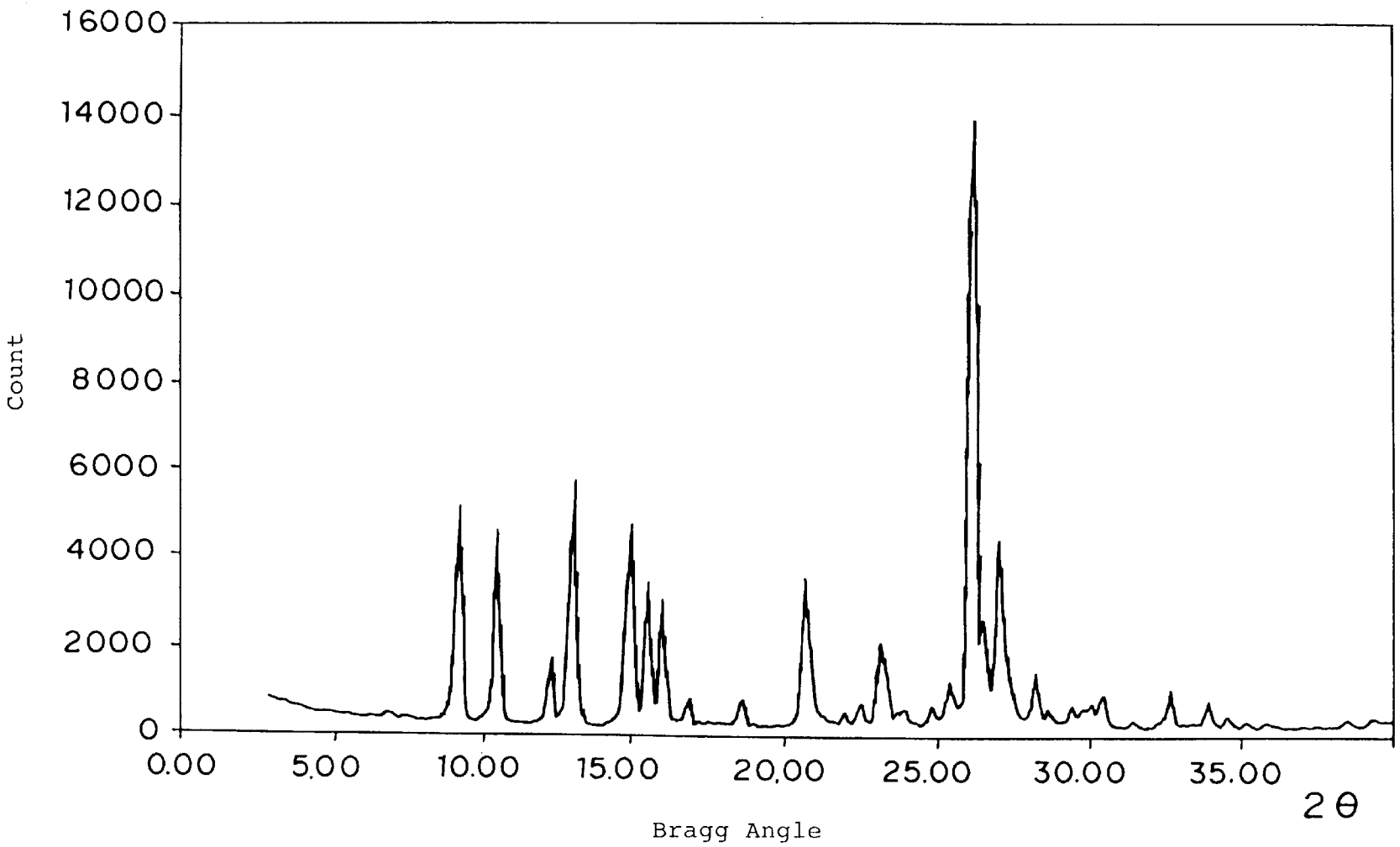

The present invention relates to an electrophotographic photoreceptor suitable for digital electrophotography used in electrophotograph. Particularly, the present invention relates to an electrophotographic photoreceptor (high γ value photoreceptor) having a threshold value in photo-induced decay curve and having only a small change in an exposure light energy for transition of from a high surface potential to a low surface potential. Also, in the present invention, the condition of "having a threshold value in photo-induced decay curve" has the following meaning. That is, in the photo-induced decay curve, the difference between an initial potential $V_0$(V) immediately after charging and a residual potential $V_r$(V) when irradiated with a light of 50 $\mu$J/cm$^2$ is expressed by $\Delta V$ ($V_o$–$V_r$). At this time, "95% surface potential" $V_{95}$ is expressed by $V_{95}=\Delta V\times 0.95+V_r$ wherein 95% value of $\Delta V$ is added to the surface potential $V_r$ and "5% surface potential" $V_5$ is expressed by $V_5=\Delta V\times 0.05+V_r$ wherein 5% value of $\Delta V$ is added to the residual potential $V_r$. Exposure light energies for providing respectively $V_{95}$ and $V_5$ are expressed by "95% exposure light energy" $E_{a5}$ and "5% exposure light energy" $E_5$, and the threshold value means that a $E_5/E_{95}$ value is at most 5.

An electrophotographic method including Carson method has been developed for the main purpose of analogously describing an original image. Thus, in order to faithfully reproduce light and darkness of input light as light and darkness of a toner image, a photosensitive material used therein has been demanded to have a property of flowing photoelectric current linearly analogous to input light amount (logarithm value). It has been therefore a principle to select a photosensitive material having such a property (low γ property) as a material for a photoreceptor. Thus, at the initial stage of the electrophotographic method, a simple photoconductive material was used, and a selenium (Se) type amorphous state photosensitive layer, a silicon (Si) amorphous layer, a ZnO binder layer made similarly to the Se amorphous layer, and the like have been used as a photosensitive material. Particularly, a function-separatable type photosensitive layer using an organic semiconductor has been recently developed and used as a photoreceptor. However, electrophotographic techniques have been recently combined with computers and communications, and printer and facsimile systems have been rapidly replaced by electrophotographic recording systems. Also, an ordinary copying machine is demanded to have image processing systems including inversion, cutting, reverse printing and the like. Therefore, an electrophotographic recording system is demanded to change from analogue recording system of conventional PPC to digital recording system.

Examples of an input light source used for the digital recording system include a semiconductor laser, a gas laser such as Ar laser and He—Ne laser, EL array, LED, shutter array of liquid crystals, and the like. Among them, the semiconductor laser is mainly used since it achieves miniaturizing and cost reduction, and it is therefore necessary to provide a photosensitive material having a high sensitivity to an oscillating wavelength of a semiconductor laser in near infrared zone.

Further, as mentioned above, a photosensitive material used in a traditional electrophotographic method based on analog idea, has a low γ property, and is therefore unsuitable for electrophotography which requires to describe input digital light signals of a computer data output printer or a digital copying machine (having a function of digital-processing images), as digital images. Thus, these photosensitive materials describe too faithfully degradation of digital signals in signaling channels of from a computer or a image-processing device to the electrophotographic device and describe also aberration in optical systems focusing light beam for writing or image-formation of an original image, and do not satisfactorily reproduce the aimed digital image. Therefore, it is strongly demanded to provide a digital photosensitive material having a high γ property and a high sensitivity usable in this technical field.

Under these circumstances, JP-A-1-169454 discloses an idea of a digital photosensitive material. However, there is no concrete description concerning a material usable for this digital photosensitive material. The present invention has been made by taking the above-mentioned situation into consideration, and an object of the present invention is to provide a photosensitive material having a high stability and a long life satisfactory for repeated use and also having excellent properties (high γ property) to digital light input.

As a result of study for solving the above-mentioned problems, the present inventors have discovered that a photosensitive material having phthalocyanine dispersed in a polycarbonate resin and containing at least one member of (i) a carboxyl group-containing compound, (ii) a resin having a predetermined acid value and (iii) a hydroxyl group-containing compound, has excellent properties (high γ property) to digital light input and also has a long life satisfactory for repeated use and a high stability as a digital photosensitive material, and the present invention has been completed on the basis of this discovery.

That is, the present invention provides an electrophotographic photoreceptor (high γ value photoreceptor) for digital light input, having a threshold value in its photo-induced decay curve and having only a small change in exposure light energy for transition of from a high surface potential to a low surface potential. The electrophotographic photoreceptor of the present invention has a photosensitive layer of titanylphthalocyanine dispersed in a binder resin provided on an electroconductive substrate, wherein the binder resin is a polycarbonate resin and the photosensitive layer contains at least one member of (i) a compound having a carboxyl group, (ii) a resin having a predetermined acid value and (iii) a compound having a hydroxyl group.

Hereinafter, the present invention is further described in more details.

(1) Titanylphthalocyanine

Various crystal forms of titanylphthalocyanine have been known heretofore, and titanylphthalocyanine used in the present invention is not specifically limited, examples of which include amorphous-form, α-form having the main peaks at Bragg angles (2θ±0.2°) of 7.60°, 25.3°, 28.6° in the X-ray diffraction spectrum using CuKα-ray, β-form having the main peaks at Bragg angles (2θ±0.2°) of 9.3°, 13.3° and 26.3° C-form having the main peaks at Bragg angles (2θ±0.2°) of 7.0°, 15.6°, 23.4° and 25.5°, and a crystal-form having peaks at Bragg angles (2θ±0.2°) of 9.5°, 24.1° and 27.3°, the diffraction peak at 27.3° being the strongest. Among them, amorphous-form, β-form and a crystal-form having peaks at Bragg angles (2θ±0.2°) of 9.5°, 24.1° and 27.3°, the diffraction peak at 27.3° being the strongest, are preferable, and titanylphthalocyanine of a crystal-form having peaks at Bragg angles (2θ±0.2°) of 9.5°, 24.1° and 27.3° in the X-ray diffraction spectrum, the diffraction peak at 27.3° being the strongest, is most preferable.

A method for synthesizing titanylphthalocyanine may be any of such known methods as "Phthalocyanine Compounds" of Moser and Thomas. For example, phthalocyanine can be obtained at a satisfactory yield by a method for heat-melting o-phthalonitrile and titanium tetrachloride or heating in the presence of an organic solvent such as α-chloronaphthalene or by a method for heating 1,3-diiminoisoindoline and tetrabutoxytitanium in an organic solvent such as N-methylpyrrolidone. The titanylphthalocynaine thus synthesized may contain a chlorine-substituted phthalocyanine. Further, the above-mentioned titanylphthalocyanine having the strongest diffraction peak at 27.3° can be prepared by such a method as disclosed in JP-A-2-289658 wherein titanylphthalocyanine is mechanically pulverized and is treated by adding water and an organic solvent, but the preparation method is not specially limited to this method and any titanylphthalocyanine prepared by any other method can be used as far as it has crystallographically the same crystal form.

(2) Polycarbonate resin

The polycarbonate resin used in the present invention is not especially limited as far as it has a structure represented by the following formula:

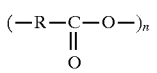

wherein R is a divalent organic residue and n is a natural number.

Examples of a method for preparing the polycarbonate resin used in the present invention include a method for polymerizing by ester interchange of an aromatic dihydroxy compound and a carbonic acid derivative (ester interchange method, molten polymerization method), a method for polymerizing an aromatic dihydroxy compound and phosgene in solution or at interface in the presence of a deoxidizer (phosgene method), a method for ring-opening polymerization of cyclic oligo carbonate, and the like.

In the preparation of the polycarbonate resin used in the present invention in accordance with the phosgene method (interfacial polymerization method), an organic solvent such as methylene chloride, toluene or xylene, and a deoxidizer such as an alkali aqueous solution are used, and polymerization is carried out by blowing phosgene into the alkali aqueous solution of a dihydroxy compound coexisting with an organic solvent. Phosgene is blown usually in a 20% excess amount. Also, in order to accelerate the polymerization reaction, a tertiary amine, a quaternary ammonium or a phosphonium salt may be added. The reaction temperature may be from 0° to 500° C., preferably from 10° to 30° C. The reaction time varies depending on the reaction temperature and other conditions including a catalyst and the like, but is from 30 minutes to 5 hours.

In the preparation of the polycarbonate resin used in the present invention in accordance with the ester interchange method, an aromatic dihydroxy compound and an aromatic ester of carbonic acid are melt-polymerized in the presence of a base catalyst. Examples of the catalyst used in the ester interchange include basic metal oxides of an alkali metal, an alkali earth metal, zinc oxide or the like, and basic metal salts such as a phosphonium salt, a quaternary ammonium salt, a hydride, an acetate or a carbonate of various metals. Polymerization is carried out by gradually reducing pressure at a polymerization temperature of from 200° to 350° C. Finally, the reaction is finished by reducing the pressure to 1 mmHg or lower. The reaction time varies depending on conditions including a temperature, a catalyst and the like, but is from 2 to 5 hours. In order to prohibit unusual reactions such as decomposition, crosslinking and the like during polymerization, the polymerization should be carried out in such an inert atmosphere as nitrogen, argon or the like.

The polycarbonate resin used as a binder resin in the present invention has preferably a number average molecular weight of from 3,000 to 500,000, more preferably from 10,000 to 200,000. Also, its glass transition temperature is from 20° to 300° C., preferably from 50° to 250° C.

These polycarbonate resins may be obtained by polymerizing the above-mentioned monomers in accordance with the above-mentioned methods, but commercially available products may be used. Examples of the commercially available products include "Upiron" (particularly Z-200 manufactured by Mitsubishi Gas Kagaku K. K., "APEC" manufactured by Bayer Japan K. K., and the like.

In the present invention, it is preferable to use substantially a polycarbonate resin only as a binder resin, but other resins may be mixed therewith in some cases.

(3-1) Compounds having carboxyl groups

A compound having a carboxyl group used in the present invention is not especially limited so long as it has a carboxyl group, but a $C_6$–$C_{30}$ aromatic carboxylic acid compound or a $C_6$–$C_2$, aliphatic carboxylic acid compound is preferable. Further, a $C_6$–$C_{25}$ aromatic carboxylic acid compound or a $C_6$–$C_{15}$ aliphatic carboxylic acid compound is more preferable. Among the above-mentioned carboxylic acid compounds, a compound having an electron-attractive group such as a halogen atom, a nitro group or an ester group as a substituent is particularly preferable. Examples of these carboxylic acid compounds include aromatic compounds such as benzoic acid, fluorinated benzoic acid, chlorinated benzoic acid, brominated benzoic acid (the number of these halogen atoms=1 to 5), trifluoromethylbenzoic acid, trichloromethylbenzoic acid, nitrobenzoic acid (the number of nitro groups=1 to 5), aminobenzoic acid (the number of amino groups=1 to 5), methylbenzoic acid (the number of methyl groups=1 to 5), t-butylbenzoic acid (the number of t-butyl groups=1 to 3), methoxybenzoic acid (the number of methoxy groups=1 to 3), sodium hydroxychlorophthalate, terephthalic acid, isophthalic acid, phthalic acid, naphthalenecarboxylic acid, naphthalenedicaboxylic acid, biphenylcarboxylic acid, biphenyldicarboxylic acid, anthracenecarboxylic acid, anthracenedicarboxylic acid, phenylacetic acid, fluorophenylacetic acid, chlorophenylacetic acid, methylphenylacetic acid, methoxyphenylacetic acid, cinnamic acid, hydroxycinnamic acid, and the like; and aliphatic compounds such as heptanoic acid, 2-ethylhexanoic acid, octanoic acid, cyclohexanepropionic acid, nonanoic acid, trimethylhexanoic acid, decanoic acid, eicosanoic acid, heptanedicarboxylic acid, 2-ethylhexanoic acid, octanedicarboxylic acid, cyclohexanepyropionic acid, nonanedicarboxylic acid, trimethylhexanoic acid, decanedicarboxylic acid, eicosanedicarboxylic acid, and the like.

A compound having a carboxyl group is added in an amount of from 0.001 to 20 wt %, preferably from 0.001 to 10 wt %, more preferably from 0.001 to 5 wt %, to the total weight of titanylphthalocyanine and a polycarbonate resin as a binder resin.

In the present invention, in place of a compound having a carboxyl group, a resin having a predetermined acid value may be used.

(3-2) Resins having predetermined acid values

A resin having an acid value of from 1 to 50 mgKOH/g used in the present invention is not especially limited so long as the acid value is within the above-mentioned predetermined range. Preferable examples include a copolymer of a polymerization-active monomer and a polymerization-active monomer having a carboxyl group in its molecule (hereinafter referred to as "carboxylic acid-containing polymerization-active monomer"). More concrete examples are illustrated hereinafter.

Examples of the above polymerization-active monomers include $C_2$–$C_8$ hydrocarbon type monomers such as ethylene, propylene, butene, butadiene, isoprene, pentene, hexene, heptene and octene, halogenated compounds of the above hydrocarbon type monomers such as vinyl chloride, vinylidene chloride, vinyl fluoride, vinylidene fluoride, ethylene trifluoride, chloroethylene trifluoride and chloroprene, vinyl esters such as vinyl formate, vinyl acetate, vinyl propionate, vinyl butyrate, vinyl hexylate or vinyl octylate, and their halogenated compounds, (meth)acrylic acid esters such as methyl (meth)acrylate, ethyl (meth)acrylate, propyl (meth)acrylate, butyl (meth)acrylate, pentyl (meth)acrylate or octyl (meth)acrylate, and their halogenated compounds, vinyl ethers such as methyl vinyl ether, ethyl vinyl ether, propyl vinyl ether, butyl vinyl ether, pentyl vinyl ether or octyl vinyl ether, and their halogenated compounds, allyl ethers such as methyl allyl ether, ethyl allyl ether, propyl allyl ether, butyl allyl ether or octyl allyl ether, and their halogenated compounds, nitrites such as acrylonitrile, fumaronitrile or methylbutylonitrile, and their halogenated compounds, maleic acid esters such as maleic anhydride, dimethyl maleate, diethyl maleate or dipropyl maleate, aromatic hydrocarbons such as styrene, α-methylstyrene or methylstyrene, and halogenated aromatic hydrocarbons such as chlorostyrene or chloromethyl styrene. Among them, hydrocarbon type monomers such as ethylene, propylene or butene, halogenated hydrocarbon type monomers such as vinyl chloride, vinylidene chloride, vinyl fluoride, vinylidene fluoride or ethylene trifluoride, vinyl esters such as vinyl acetate, vinyl propionate or vinyl butylate, (meth) acrylic acid esters such as methyl (meth)acrylate or ethyl (meth)acrylate, aromatic hydrocarbons such as styrene, α-methylstyrene or methylstyrene, and halogenated aromatic hydrocarbons such as chlorostyrene or chloromethylstyrene, are preferable. More preferable examples include vinyl esters such as vinyl acetate, vinyl propionate or vinyl butyrate, and (meth)acrylic acid esters such as methyl (meth)acrylate or ethyl (meth)acrylate.

Examples of carboxylic acid-containing polymerization-active monomers include (meth)acrylic acid, maleic acid, fumaric acid, itaconic acid, styrene carboxylic acid and the like. Among them, (meth)acrylic acid and maleic acid are preferable, and (meth)acrylic acid is more preferable.

Copolymerization of a polymerization-active monomer and a carboxylic acid-containing polymerization-active monomer is usually carried out by free radical polymerization, but may be carried out by ionic polymerization. A charging ratio of the two monomers is adjusted so as to provide a copolymer having an acid value of from 1 to 50 mgKOH/g. Reaction speed, copolymerization ratio and carboxylic acid content vary depending on a polymerization-active monomer and a carboxylic acid-containing polymerization-active monomer used, but the carboxylic acid-containing polymerization-active monomer is generally used in an amount of from 0.1 mol % to 19 mol %, preferably from 0.2 to 14 mol %, to the polymerization-active monomer.

The radical polymerization may be carried out either in solution or in suspension. In the case of solution polymerization, examples of a solvent used to dissolve the above polymerization-active monomer include toluene, xylene, tetrahydrofuran, dioxane, N,N-dimethylformamide and the like, and a radical initiator may be added thereto. In a case of suspension polymerization, a radical initiator is added to a mixture solution of the above polymerization-active monomer and carboxylic acid-containing polymerization-active monomer, and the resultant mixture is poured into a large amount of water to make suspension polymerization.

A radical initiator may be any one used for general radical polymerization, examples of which include an organic peroxide such as benzoyl peroxide or lauroyl peroxide, an azo compound such as azobisisobutylonitrile, an inorganic peroxide such as hydrogen peroxide or potassium persulfate, and the like.

Polymerization temperature and polymerization time vary depending on an initiator used, but the polymerization temperature is preferably from 20° to 150° C., more preferably from 50° to 120° C., and the polymerization time is preferably from 1 to 30 hours, more preferably from 3 to 20 hours.

Isolation of a copolymer can be carried out by pouring a polymerization solution into a poor solvent such as ether or hexane to precipitate the copolymer in the case of solution polymerization or by subjecting a suspension to filtration or centrifugal separation to isolate the copolymer in the case of suspension polymerization.

An acid value of the copolymer is from 1 to 50 mgKOH/g, preferably from 1 to 45 mgKOH/g, more preferably from 1 to 40 mgKOH/g.

The copolymer has a number average molecular weight of preferably from 3,000 to 500,000, more preferably from 5,000 to 300,000.

The resin having such an acid value may be obtained by polymerizing the above-mentioned various polymerization-active monomers in accordance with the above-mentioned methods, but may be a commercially available product. Examples of the commercially 25 available products include "BR Resin" of Mitsubishi Rayon K. K., "Cefralcoat" of Central Glass K. K., "Silar Coat" of Asahi Glass Company Ltd., and the like.

The above resin having a predetermined acid value is added in an amount of from 5 to 30 wt %, preferably from 5 to 25 wt %, more preferably from 5 to 20 wt %, to the weight of a polycarbonate resin used as a binder resin. Even when the addition amount of the resin having the above predetermined acid value is 30 wt % or higher, a photosensitive material having a high γ property can be obtained, but such a photosensitive material tends to become poor in repetitious properties.

The resin used should preferably have a good compatibility with a polycarbonate resin, but any resin which does not cause phase separation with the polycarbonate resin is usable without causing any problem. Since the resin having the above predetermined acid value is a resin, it does not lower mechanical properties (such as abrasion resistance and scratching resistance) of a photosensitive material even when it is used in a larger amount.

In the present invention, a compound having a hydroxyl group may be used in place of the above-mentioned carboxyl group-containing compound or the resin having an acid value of from 1 to 50 mgKOH/g.

(3-3) Compounds having hydroxyl group

A compound having a hydroxyl group used in the present invention is not especially limited so long as it has a hydroxyl group, examples of which include a $C_6$–$C_{30}$ compound having an aromatic hydroxyl group and a $C_6$–$C_{20}$ compound having an aliphatic hydroxyl group. Further, a $C_6$–$C_{25}$ compound having an aromatic hydroxyl group and a $C_6$–$C_{15}$ compound having an aliphatic hydroxyl group are preferable. Among these compounds, a compound having an electron-attractive group such as a halogen atom, a nitro group or an ester group as a substituent is more preferable. Particular examples of the compound having an aromatic hydroxyl group include phenol, fluorinated phenol, chlorinated phenol, brominated phenol (the number of halogen atoms=1 to 5), trifluoromethylphenol, trichloromethylphenol, nitrophenol (the number of nitro group=1 to 5), cyanophenol (the number of cyano group=1 to 5), aminophenol (the number of amino group=1 to 5), methylphenol (the number of methyl group=1 to 5), t-butylphenol (the number of t-butyl group=1 to 3), methoxyphenol (the number of methoxy group=1 to 3), hydroxybenzaldehyde, hydroxyacetophenone, salicylic acid, benzyl alcohol, chlorobenzyl alcohol, bromobenzyl alcohol, fluorobenzyl alcohol, methylhydroxybenzoate, phenylphenol (the number of phenyl group=1 to 3), phenylazophenol, hydroxynaphthophenone, hydroxynaphthalene, dihydroxynaphthalene, bisphenol A, bisphenol F, tetrabromobisphenol A, tetrabromobisphenol A-bishydroxyethyl ether, and the like.

Particular examples of the compound having an aliphatic hydroxyl group include chlorohexanol, bromohexanol, fluorohexanol, chlorocyclohexanol, haptanol, chloroheptanol, octanol, nonanol, trimethyhexanol, decanol, eicosanol, heptane diol, octane diol, nonane diol, decane diol, eicosane diol, and the like.

The above compound having a hydroxyl group is added in an amount of from 0.001 to 20 wt %, preferably from 0.001 to 10 wt %, more preferably from 0.001 to 5 wt %, to the total weight of titanylphthalocyanine and a polycarbonate resin as a binder resin.

(4) Electrophotographic photoreceptor

The electrophotographic photoreceptor of the present invention can be obtained by having an electroconductive substrate provided with a photosensitive layer having the above-mentioned titanylphthalocyanine and at least one member of the above-mentioned (i) a carboxyl group-containing compound, (ii) a resin having an acid value of from 1 to 50 mgKOH/g and (iii) a hydroxyl group-containing compound dispersed in the above-mentioned polycarbonate resin. That is, titanylphthalocyanine, at least one of the above compounds (i) to (iii) and a polycarbonate resin are uniformly dispersed by a dispersion mixer such as a ball mill or an atriter, and the dispersion thus obtained is coated on an electroconductive substrate to form a single layer of photosensitive layer.

The addition of a carboxyl group-containing compound or a hydroxyl group-containing compound is further illustrated in more details hereinafter.

Titanylphthalocyanine and a polycarbonate resin are mixed in a weight ratio of from 1/10 to 1/1 (titanylphthalocyanine/polycarbonate resin), and a carboxyl group-containing compound or a hydroxyl group-containing compound is added thereto in an amount of from 0.001 to 20 wt % to the total weight of titanylphthalocyanine and the polycarbonate resin, and they are mixed with a solvent. The resultant dispersion thus mixed is coated on an electroconductive substrate such as a metal including alumina or paper and plastic which are treated to be electroconductive, thereby forming a photosensitive layer.

A solvent used for the coating solution is selected preferably from solvents which dissolve the above polycarbonate resin and which inhibit crystal growth of titanylphthalocyanine and do not affect unfavorably on properties of titanylphthalocyanine. Examples of the solvent having such preferable properties include hydrocarbons such as toluene, xylene or mineral spirit, ketones such as acetone, methyl ethyl ketone, methyl butyl ketone or cyclohexanone, hydrogenated hydrocarbons such as dichloromethane, dichloroethane, trichloroethane or chlorobenzene, ethers such as tetrahydrofuran, dioxane, monoglyme, diglyme or anisole, alcohols such as methanol, ethanol, propanol, butanol, methylcellusolve, ethylcellusolve, butylcellusolve or cyclohexanol, esters such as ethyl acetate, propyl acetate or butyl acetate, amines such as dimethylformamide or N-methylpyrrolidone, and the like. These solvents may be used alone or in a mixture of two or more.

In the coating process, if necessary, a solvent such as toluene or cyclohexanone may be added to the above mixture to adjust a viscosity, and a coating film is formed by coating the above prepared coating solution by a coating system employing an air doctor coater, a plate coater, a dip coater, a ring coater, a rod coater, a reverse coater, a spray coater, a hot coater, a squeeze coater, a graver coater or the like. After coating, the coating film is dried so as to be able to impart a satisfactory charged potential as a photoconductive layer. The coating is carried out at a temperature of 30° to 300° C. for 1 minute to 24 hours after preliminarily low drying at room temperature.

On the other hand, a resin having the above-mentioned predetermined acid value is added in the following manner.

A mixture of a polycarbonate resin and a resin having the above-mentioned specific acid value and titanylphthalocyanine are mixed with a solvent in a weight ratio of from 1/1 to 10/1 (mixed resins/titanylphthalocyanine). Thereafter, the resultant coating solution containing the mixed resins and titanylphthalocyanine is coated on an electroconductive substrate used for a usual electrophotographic photoreceptor, such as a metal including aluminum or paper or plastic which is treated so as to be electroconductive, thereby forming a photosensitive layer. A solvent used in this coating solution is selected from solvents which dissolve the above mixed resins and which inhibit crystal growth of titanylphthalocyanine and do not affect unfavorably on properties of titanylphthalocyanine.

Examples of such solvents include those illustrated with regard to the above carboxyl group-containing compounds, and the coating method may also be the same as illustrated with regard to the above carboxyl group-containing compounds.

The electrophotographic photoreceptor of the present invention prepared in the above-mentioned manner (hereinafter referred to as "the electrophotographic photoreceptor of the present invention") generally has a weight ratio of resin/photoconductive material of at least 1. Thus, the resin amount of the electrophotographic photoreceptor of the present invention is much larger as compared with a conventional electrophotographic photoreceptor using zinc oxide and having a resin/photoconductive material weight ratio of 0.2. Accordingly, the electrophotographic photoreceptor of the present invention has a coating film having a high physical strength and a high flexibility.

Further, in order to improve various properties of the electrophotographic photoreceptor, an undercoat layer may be provided between an electroconductive substrate and a photosensitive layer and an overcoat layer may be provided on the photosensitive layer. Also, in order to improve stability, an additive such as an antioxidant may be added. The photosensitive layer thus obtained has a film, thickness of preferably in the range of from 5 to 50 $\mu$m, more preferably in the range of from 10 to 30 $\mu$m.

The electrophotographic photoreceptor of the present invention prepared as mentioned above, has various excellent practical advantages such as a large adhesiveness with an electroconductive substrate, a satisfactory moisture resistance, no change as a lapse of time, no poisonous problem, easy production and low cost.

The electrophotographic photoreceptor of the present invention prepared as mentioned above, is usually positively charged, and can be used for digital light input since it provides a unique photoelectric current flowing as compared with a conventional electrophotographic photoreceptor.

That is, a conventional electroconductive photoreceptor provides a photoelectric current flowing in an amount linearly corresponding to an input light amount (logarithm value), whereas the electrophotographic photoreceptor of the present invention has a threshold value in a photo-induced decay curve (see FIG. 4) wherein a photoelectric current does not flow or flows only in a very small amount until a predetermined input light amount is obtained and remarkably flows immediately after exceeding the predetermined light amount.

In digital recording system, image gradation is expressed by dot areas, and therefore an electrophotographic photoreceptor used for this recording system should preferably have the above-mentioned photosensitivity properties. This is because even when laser spot is precisely modified by optical system, it is impossible in principle to avoid halo and light amount distribution of the spot itself.

Accordingly, a conventional electrophotographic photoreceptor which picks up a change in light energy (input light amount) step-wisely, changes a dot pattern depending on the change in light amount and causes a fogging as a noise.

Thus, the electrophotographic photoreceptor of the present invention is particularly advantageous for digital light input.

EXAMPLES

Now, the present invention will be described in further detail with reference to Examples. However, it should be understood that the present invention is not limited to such specific Examples and that any changes or modifications can be made by those skilled in the art within the spirit and scope of the present invention.

(Preparation Example of titanylphthalocyanine)

Preparation Example 1

58 g of 1,3-diiminoisoindoline and 51 g of tetrabutoxytitanium were reacted in 300 ml of α-chloronaphthalene at 210° C. for 5 hours, and the reaction mixture was filtrated under heating at 150° C. and was washed with α-chloronaphthalene and dimethylformamide (DMF) in this order. Thereafter, the reaction product was washed with hot DMF, hot water and methanol, and was dried to obtain 51 g of titanylphthalocyanine. The titanylphthalocyanine thus obtained had an X-ray diffraction spectrum as shown in FIG. 1, and was a β-type titanylphthalocyanine having diffraction peaks at Bragg angles (2θ±0.2°) of 9.3°, 13.2° and 26.2°.

Preparation Example 2

Figure 2:
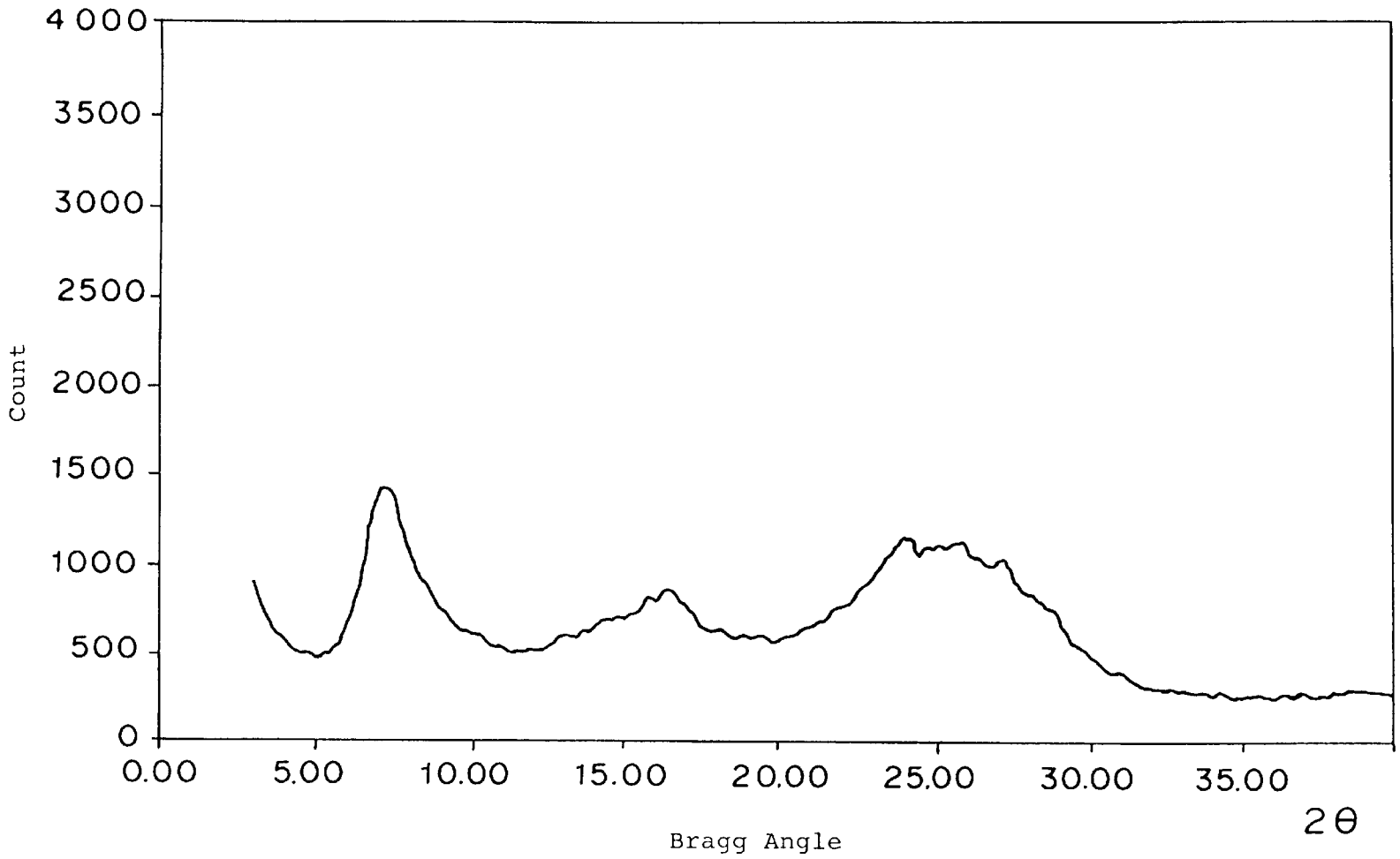

4 g of titanylphthalocyanine prepared in Preparation Example 1 was dissolved in 400 g of sulfuric acid at 0° C., and the acid solution thus obtained was dropped into 4 l of water cooled at 0° C. After finishing dropping, the mixture was stirred for 1 hour and was filtrated and was washed with water until the filtrate becomes neutral, thus obtaining 3.1 g of titanylphthalocyanine. The titanylphthalocyanine thus obtained had an X-ray diffraction spectrum as shown in FIG. 2, and was an amorphous type titanylphthalocyanine which did not especially have a sharp peak.

Preparation Example 3

Figure 3:
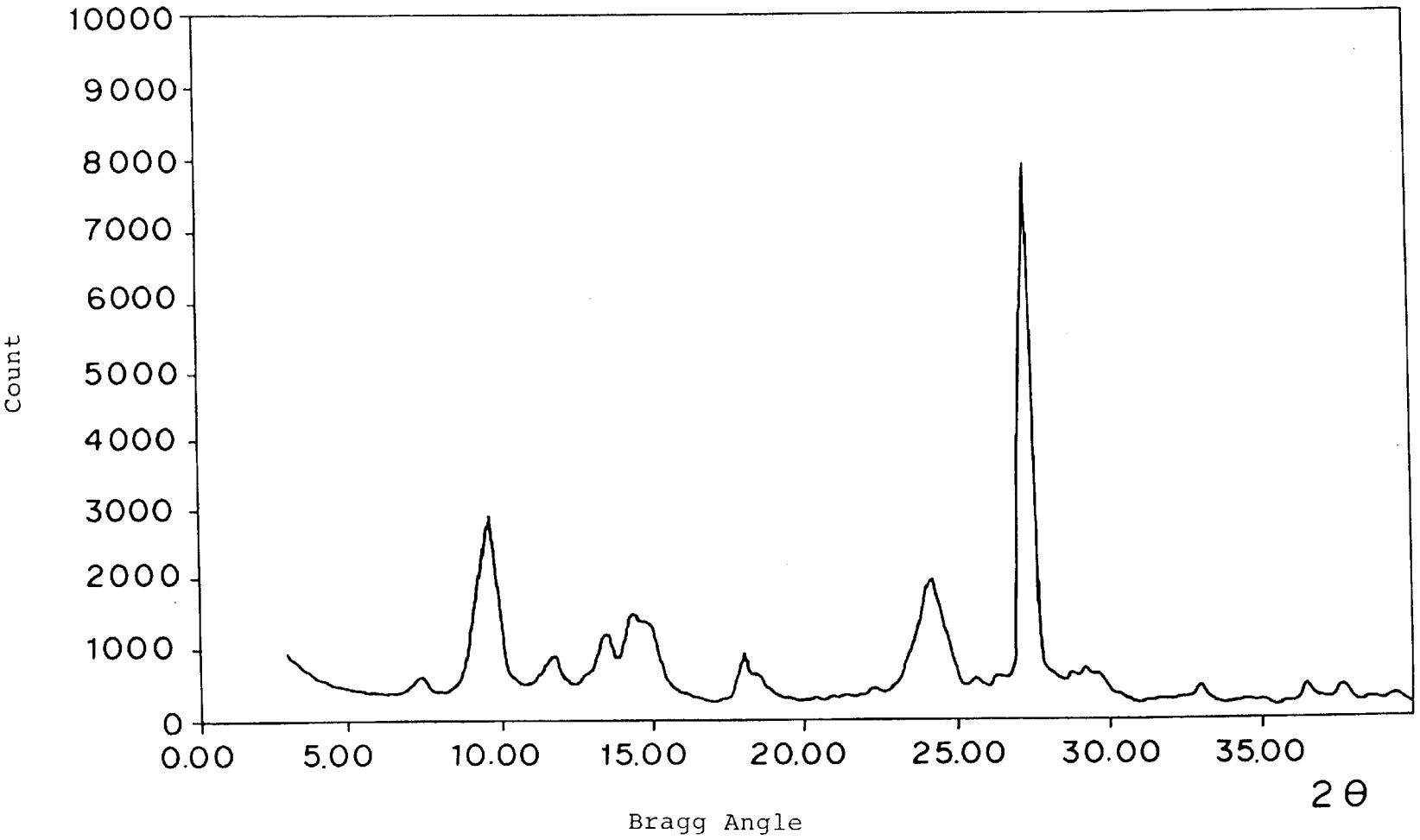

6 g of titanylphthalocyanine prepared in Preparation Example 1 and 50 g of glass beads were placed in a 100 ml polyethylene bottle, and were pulverized in a paint shaker (manufactured by Red Devil Company) for 40 hours. Thereafter, the titanylphthalocyanine thus obtained was separated from the glass beads with methanol, and the titanylphthalocyanine was washed with 100 ml of water. The titanylphthalocyanine wet cake thus obtained was placed in a mixture solution of 100 ml of water and 10 ml of dichlorobenzene, and was stirred for 1 hour. After filtrating and then washing with methanol, 4.3 g of titanylphthalocyanine was obtained. The titanylphthalocyanine thus obtained had an X-ray diffraction spectrum as shown in FIG. 3, and had diffraction peaks at Bragg angles (2θ±0.2°) of 9.5°, 24.1° and 27.3°, among which the diffraction peak at 27.3° was the strongest.

(Preparation of polycarbonate resin)

Preparation Example 4

A 2 l flask equipped with a stirring device, a refluxing cooler, a thermometer, a gas-introducing tube, a pH electrode and a dropping funnel, was substituted with nitrogen, and 1,1-bis(4-hydroxyphenyl)-cyclohexane (147.4 g , 0.55 mol), sodium hydrogen sulfite (0.11 g), a sodium hydroxide aqueous solution (NaOH: 55 g, 1.38 mol, water: 600 ml) and methylene chloride (400 ml) were placed in the flask. The reaction temperature was maintained at 23° to 27° C. and phosgene was blown into the reaction solution under vigorously stirring until the pH value of the reaction solution was lowered to 7.

The time required for the reaction was about 2 hours. About 70 g of phosgene was used. Thereafter, sodium hydroxide aqueous solution (NaOH: 30 g, water: 30 ml) and benzyltriethylammonium chloride (4.8 g) were added thereto, and the mixture was vigorously stirred at 25° to 35° C. for 1 hour. After finishing the reaction, the organic phase was separated from the aqueous phase, and the organic phase was washed with water (500 ml) three times and was further washed with 2% HCl aqueous solution (500 ml) and water (500 ml). After washing, the resultant product was placed in methanol, and was separated by filtration and was dried under reduced pressure at 100° C. for 10 hours.

Preparation Example 5

The same polymerization procedure as in Preparation Example 4 was repeated, except that 1,1-bis(4-hydroxyphenyl)-cyclohexane (147.4 g, 0.55 mol) was replaced by 1,1-bis(4-hydroxyphenyl)-cyclohexane (73.7 g, 0.275 mol) and Bisphenol A (62.5 g, 0.275 mol).

Preparation Example 6

The same polymerization procedure as in Preparation Example 4 was repeated, except that 1,1-bis(4-hydroxylphenyl)-cyclohexane (147.4 g, 0.55 mol) was replaced by 1,1-bis(4-hydroxyphenyl)-cyclohexane (73.7 g, 0.275 mol) and Bisphenol F (55 g, 0.275 mol).

Preparation Example 7

The same polymerization procedure as in Preparation Example 4 was repeated, except that 1,1-bis(4-hydroxylphenyl)-cyclohexane (147.4 g, 0.55 mol) was replaced by 1,1-bis(4-hydroxyphenyl)-3,3,5-trimethylcyclohexane (170.5 g, 0.275 mol) and Bisphenol A (62.5 g, 0.275 mol).

Preparation Example 8

The same polymerization procedure as in Preparation Example 4 was repeated, except that 1,1-bis(4-hydroxylphenyl)-cyclohexane (147.4 g, 0.55 mol) was replaced by 1,1-bis(4-hydroxyphenyl)-cyclohexane (73.7 g, 0.275 mol) and 1,1-bis(4-hydroxyphenyl)-phenyl-ethane (79.8 g, 0.275 mol).

(Preparation example of resin having acid value)

Preparation Example 9

31 g of vinylacetate, 3.5 g of methacrylic acid (vinylacetate/methacrylic acid mol ratio: 9/1) and 1.6 g of lauroylperoxide were dissolved in 40 ml of toluene, and were polymerized at 80° C. for 5 hours. Thereafter, the reaction mixture was poured into 2 l of ether, and a copolymer was precipitated. The copolymer thus obtained was dissolved in 50 ml of dimethylformamide again, and was precipitated with 2 l of ether and was dried under vacuum at 80° C. for 12 hours. The copolymer was obtained at a yield of 24 g. An acid value of the copolymer determined by titration method was 35.4 mgKOH/g, and a number average molecular weight determined by GPC (polystyrene conversion, moving phase: tetrahydrofuran) was 25,000.

Preparation Example 10

37.1 g of methyl methacrylater 3.5 g of methacrylic acid (methyl methacrylate/methacrylic acid mol ratio: 9/1) and 0.8 g of lauroyl peroxide were dissolved in 40 ml of toluene, and were polymerized at 80° C. for 5 hours. Thereafter, the reaction mixture was poured into 2 l of ether, and a copolymer was precipitated. The copolymer thus obtained was dissolved again in 50 ml of dimethylformamide, and was precipitated with 2 l of ether and was dried under vacuum at 80° C. for 12 hours. The copolymer was obtained at a yield of 26 g. The copolymer thus obtained had an acid value of 38.1 mgKOH/g and a number average molecular weight of 43,000.

Preparation Example 11

26.5 g of methyl methacrylate, 2.45 g of methacrylic acid (methyl methacrylate/methacrylic acid mol ratio: 9/1) and 0.082 g of lauroyl peroxide were dissolved in 100 ml of toluene, and were polymerized at 70° C. for 10 hours. Thereafter, the reaction mixture was poured into 2 l of ether, and a copolymer was precipitated. The copolymer thus obtained was dissolved again in 50 ml of dimethylformamide, and was precipitated with 2 l of ether and was dried under vacuum at 80° C. for 12 hours. The copolymer was obtained at a yield of 16.5 g. The copolymer thus obtained had an acid value of 40.3 mgKOH/g and a number average molecular weight of 140,000.

Preparation Example 12

53 g of methyl methacrylate, 4.9 g of methacrylic acid (methyl methacrylate/methacrylic acid mol ratio: 9/1) and 0.082 g of lauroyl peroxide were dissolved in 100 ml of toluene, and were polymerized at 70° C. for 10 hours. Thereafter, the reaction mixture was poured into 3 l of ether, and a copolymer was precipitated. The copolymer thus obtained was dissolved again in 100 ml of dimethylformamide, and was precipitated with 4 l of ether and was dried under vacuum at 80° C. for 12 hours. The copolymer was obtained at a yield of 37 g. The copolymer thus obtained had an acid value of 35.9 mgKOH/g and a number average molecular weight of 300,000.

Preparation Example 13

40.8 g of methyl methacrylate, 0.34 g of methacrylic acid (methyl methacrylate/methacrylic acid mol ratio: 9.9/0.1) and 0.8 g of lauroyl peroxide were dissolved in 40 ml of toluene, and were polymerized at 80° C. for 5 hours. Thereafter, the reaction mixture was poured into 2 l of ether, and a copolymer was precipitated. The copolymer thus obtained was dissolved again in 50 ml of dimethylformamide, and was precipitated with 2 l of ether and was dried under vacuum at 80° C. for 12 hours. The copolymer was obtained at a yield of 21 g. The copolymer thus obtained had an acid value of 4.3 mgKOH/g and a number average molecular weight of 35,000.

Preparation Example 14

53 g of methyl methacrylate, 2.3 g of methacrylic acid (methyl methacrylate/methacrylic acid mol ratio: 9.5/0.5) and 0.082 g of lauroyl peroxide were dissolved in 100 ml of toluene, and were polymerized at 70° C. for 10 hours. Thereafter, the reaction mixture was poured into 3 l of ether, and a copolymer was precipitated. The copolymer thus obtained was dissolved again in 50 ml of dimethylformamide, and was precipitated with 2 l of ether and was dried under vacuum at 80° C. for 12 hours. The copolymer was obtained at a yield of 17 g. The copolymer thus obtained had an acid value of 20.2 mgKOH/g and a number average molecular weight of 350,000.

Preparation Example 15

53 g of methyl methacrylate, 3.3 g of maleic acid (methyl methacrylate/maleic acid mol ratio: 9/1) and 0.082 g of lauroyl peroxide were dissolved in 100 ml of toluene, and were polymerized at 70° C. for 10 hours. Thereafter, the reaction mixture was poured into 3 l of ether, and a copolymer was precipitated. The copolymer thus obtained was dissolved again in 50 ml of dimethylformamide, and was precipitated with 2 l of ether and was dried under vacuum at 80° C. for 12 hours. The copolymer was obtained at a yield of 26 g. The copolymer thus obtained had an acid value of 37.8 mgKOH/g and a number average molecular weight of 210,000.

Preparation Example 16

53.5 g of styrene, 4.9 g of methacrylic acid (styrene/methacrylic acid mol ratio: 9/1) and 0.082 g of lauroyl peroxide were dissolved in 100 ml of toluene, and were polymerized at 70° C. for 10 hours. Thereafter, the reaction mixture was poured into 3 l of ether, and a copolymer was precipitated. The copolymer thus obtained was dissolved again in 100 ml of dimethylformamide, and was precipitated with 4 l of ether and was dried under vacuum at 80° C. for 12 hours. The copolymer was obtained at a yield of 22 g. The copolymer thus obtained had an acid value of 25.4 mgKOH/g and a number average molecular weight of 260,000.

(Comparative Examples)

Hereinafter, in order to evaluate a resin having an acid value prepared by each Example of the present invention, the following resins were prepared as Comparative Examples.

Comparative Preparation Example 1

Comparative Preparation Example 1 is different from Preparation Example 10 in respect that Comparative Preparation Example 1 is not a copolymer of methyl methacrylate and methacrylic acid but a homopolymer of methyl methacrylate. In this Comparative Preparation Example 1, 37.1 g of methyl methacrylate and 0.8 g of lauroyl peroxide were dissolved in 40 ml of toluene, and were polymerized at 80° C. for 5 hours. Thereafter, the reaction mixture was poured into 2 l of ether and a polymer was precipitated. The polymer thus obtained was dissolved again in 50 ml of dimethylformamide, and was precipitated again with 2 l of ether and was dried under vacuum at 80° C. for 12 hours. The polymer was obtained at a yield of 32 g. The polymer thus obtained had an acid value of 0 mgKOH/g and a number average molecular weight of 28,000.

Comparative Preparation Example 2

Comparative Preparation Example 2 is different from Preparation Example 10 in respect that the amount of methacrylic acid charged is large in the charging ratio of methyl methacrylate and methacrylic acid. In this Comparative Preparation Example 2, 33 g of methyl methacrylate, 6.9 g of methacrylic acid (methyl methacrylate/methacrylic acid mol ratio: 8/2) and 0.8 g of lauroyl peroxide were dissolved in 40 ml of toluene, and were polymerized at 80° C. for 5 hours. Thereafter, the reaction mixture was poured into 2 l of ether, and a copolymer was precipitated. The polymer thus obtained was dissolved again in 50 ml of dimethylformamide, and was precipitated again with 2 l of ether and was dried under vacuum at 80° C. for 12 hours. The copolymer was obtained at a yield of 20 g. The polymer thus obtained had an acid value of 72 mgKOH/g and a number average molecular weight of 33,000.

Comparative Preparation Example 3

Comparative Preparation Example 3 is different from Preparation Example 10 in respect that the amount of methacrylic acid charged is further larger in the charging ratio of methyl methacrylate and methacrylic acid. In this Comparative Preparation Example 3, 20.6 g of methyl methacrylate, 17.2 g of methacrylic acid (methyl methacrylate/methacrylic acid mol ratio: 5/5) and 0.8 g of lauroyl peroxide were dissolved in 40 ml of toluene, and were polymerized at 80° C. for 5 hours. Thereafter, the reaction mixture was poured into 2 l of ether, and a copolymer was precipitated. The polymer thus obtained was dissolved again in 50 ml of dimethylformamide, and was precipitated again with 2 l of ether and was dried under vacuum at 80° C. for 12 hours. The copolymer was obtained at a yield of 19 g. The copolymer thus obtained had an acid value of 215.6 mgKOH/g and a number average molecular weight of 310,000.

(Electrophotographic photoreceptor containing a compound having a hydroxyl group)

Example 1

0.25 g of titanylphthalocyanine obtained in Preparation Example 1 and 12.5 mg (1 wt %) of bromophenol, together with 1.0 g of polycarbonate resin obtained in Preparation Example 4, 6.5 g of toluene and 12 g of glass beads (diameter 2 mm), were sealed in a glass container, and were dispersed by a paint shaker (manufactured by Red Devil Company) for 4 hours. After dispersion, glass beads were separated to obtain a photosensitive material coating solution. The photosensitive material coating solution was coated on a degreased aluminum sheet having a thickness of 90 μm by wire bar method, and was preliminarily dried at room temperature. Thereafter, it was dried in an oven at 100° C. for 1 hour to obtain an electrophotographic photoreceptor having a photosensitive layer of a film thickness of 18 μm.

Examples 2 to 41

Electrophotographic photoreceptors were prepared in the same manner as in Example 1, except that 0.25 g of titanylphthalocyanine (TiOPc), hydroxyl group-containing compounds and 1.0 g of polycarbonate resins (PCR) as shown in the following Table 1 were used.

TABLE 1

| Example | TiOPc | Hydroxyl group-containing compound (mg, wt %) | PCR |
|---|---|---|---|
| 2 | Preparation Example 2 | Bromophenol (12.5, 1) | Preparation Example 4 |
| 3 | Preparation Example 3 | Bromophenol (12.5, 1) | Preparation Example 4 |
| 4 | Preparation Example 2 | Bromophenol (12.5, 1) | Preparation Example 5 |
| 5 | Preparation Example 3 | Bromophenol (12.5, 1) | Preparation Example 5 |
| 6 | Preparation Example 2 | Bromophenol (12.5, 1) | Preparation Example 6 |
| 7 | Preparation Example 3 | Bromophenol (12.5, 1) | Preparation Example 6 |
| 8 | Preparation Example 2 | Bromophenol (12.5, 1) | Preparation Example 7 |
| 9 | Preparation Example 3 | Bromophenol (12.5, 1) | Preparation Example 7 |
| 10 | Preparation Example 2 | Bromophenol (12.5, 1) | Preparation Example 8 |
| 11 | Preparation Example 3 | Bromophenol (12.5, 1) | Preparation Example 8 |
| 12 | Preparation Example 3 | Bromophenol (37.5, 3) | Preparation Example 7 |
| 13 | Preparation Example 3 | Bromophenol (87.5, 7) | Preparation Example 7 |
| 14 | Preparation Example 3 | Bromophenol (150, 12) | Preparation Example 7 |
| 15 | Preparation Example 3 | Dibromophenol (12.5, 1) | Preparation Example 7 |
| 16 | Preparation Example 3 | Tribromophenol (12.5, 1) | Preparation Example 7 |
| 17 | Preparation Example 3 | Pentabromophenol (12.5, 1) | Preparation Example 7 |
| 18 | Preparation Example 3 | Fluorophenol (12.5, 1) | Preparation Example 7 |
| 19 | Preparation Example 3 | Fluoromethylphenol (12.5, 1) | Preparation Example 7 |
| 20 | Preparation Example 3 | Chlorophenol (12.5, 1) | Preparation Example 7 |
| 21 | Preparation Example 3 | Pentachlorophenol (12.5, 1) | Preparation Example 7 |
| 22 | Preparation Example 3 | Nitrophenol (12.5, 1) | Preparation Example 7 |
| 23 | Preparation Example 3 | Cyanophenol (12.5, 1) | Preparation Example 7 |
| 24 | Preparation Example 3 | Hydroxybenzaldehyde (12.5, 1) | Preparation Example 7 |
| 25 | Preparation Example 3 | Hydroxyacetophenone (12.5, 1) | Preparation Example 7 |
| 26 | Preparation Example 3 | Methylhydroxybenzoate (12.5, 1) | Preparation Example 7 |
| 27 | Preparation Example 3 | Methoxyphenol (12.5, 1) | Preparation Example 7 |
| 28 | Preparation Example 3 | Phenylphenol (12.5, 1) | Preparation Example 7 |
| 29 | Preparation Example 3 | Phenylazophenol (12.5, 1) | Preparation Example 7 |
| 30 | Preparation Example 3 | Hydroxynaphthoquinone (12.5, 1) | Preparation Example 7 |
| 31 | Preparation Example 3 | Hydroxynaphthalene (12.5, 1) | Preparation Example 7 |
| 32 | Preparation Example 3 | Hydroxydinaphthalene (12.5, 1) | Preparation Example 7 |
| 33 | Preparation Example 3 | Bisphenol A (12.5, 1) | Preparation Example 7 |
| 34 | Preparation Example 3 | Bisphenol F (12.5, 1) | Preparation Example 7 |
| 35 | Preparation Example 3 | Tetrabromobisphenol A (12.5, 1) | Preparation Example 7 |
| 36 | Preparation Example 3 | Tetrabromobisphenol A-bishydroxyethyl-ether (12.5, 1) | Preparation Example 7 |

TABLE 1-continued

| Example | TiOPc | Hydroxyl group-containing compound (mg, wt %) | PCR |
|---|---|---|---|
| 37 | Preparation Example 3 | Benzyl alcohol (12.5, 1) | Preparation Example 7 |
| 38 | Preparation Example 3 | Bromobenzyl alcohol (12.5, 1) | Preparation Example 7 |
| 39 | Preparation Example 3 | Hexanediol (12.5, 1) | Preparation Example 7 |
| 40 | Preparation Example 3 | Chlorohexanol (12.5, 1) | Preparation Example 7 |
| 41 | Preparation Example 3 | Bromophenol (225, 18) | Preparation Example 7 |

Hereinafter, in order to evaluate a hydroxyl group-containing compound of each Example of the present invention, the following Comparative Examples are illustrated.

Comparative Example 1

0.25 g of titanylphthalocyanine obtained by Preparation Example 1, together with 1.0 g of polycarbonate obtained by Preparation Example 4, 6.5 g of toluene and 12 g of glass beads (diameter 2 mm), were sealed in a glass container, and were dispersed by a paint shaker (manufactured by Red Devil Company) for 4 hours. After dispersion, glass beads were separated to obtain a photosensitive material coating solution. The photosensitive material coating solution was coated on a degreased aluminum sheet having a thickness of 90 $\mu$m by wire bar method, and was preliminarily dried at room temperature. Thereafter, it was dried in an oven at 100° C. for 1 hour to obtain an electrophotographic photoreceptor having a photosensitive layer of a film thickness of 18 $\mu$m.

Comparative Examples 2 to 9

Comparative electrophotographic photoreceptors were prepared in the same manner as in Comparative Example 1, except that 0.25 g of titanylphthalocyanine (TiOPc) and 1.0 g of polycarbonate resin (PCR) as shown in the following Table 2 were used.

In Comparative Example 9, pentabromotoluene was used in place of a hydroxyl group-containing compound.

TABLE 2

| Comparative Example | TiOPc | Hydroxyl group-containing compound (mg, wt %) | PCR |
|---|---|---|---|
| 2 | Preparation Example 2 | nil | Preparation Example 4 |
| 3 | Preparation Example 3 | nil | Preparation Example 4 |
| 4 | Preparation Example 2 | nil | Preparation Example 5 |
| 5 | Preparation Example 3 | nil | Preparation Example 5 |
| 6 | Preparation Example 3 | nil | Preparation Example 6 |
| 7 | Preparation Example 3 | nil | Preparation Example 7 |
| 8 | Preparation Example 3 | nil | Preparation Example 8 |
| 9 | Preparation Example 3 | Pentabromotoluene (12.5, 1) | Preparation Example 7 |

(Evaluation of electrophotographic photoreceptor)

Electrophotographic photoreceptors prepared in respective Examples and Comparative Examples were evaluated in respect to photosensitivity properties by using an electrophotographic photoreceptor evaluation device (CYNTHIA-55, manufactured by GENETIC Company).

Figure 4:
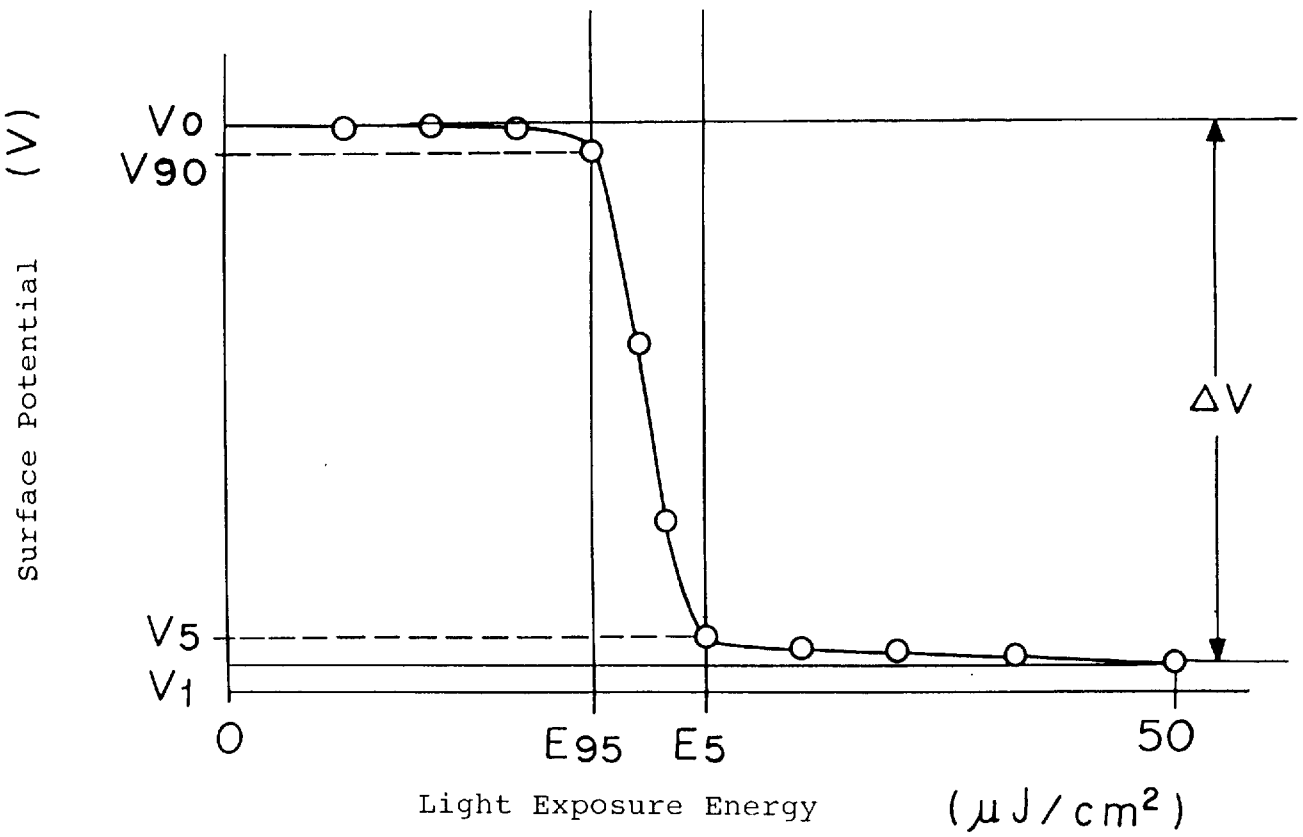

First, an electrophotographic photoreceptor was corona-charged under a voltage of +6.0 KV, and the corona-charged electrophotographic photoreceptor was irradiated with monochromatic light of 780 nm different in photo intensities, and a photo-induced decay-time curve (surface potential property curve to irradiation time) was respectively measured. Thereafter, from the curve, a surface potential after irradiating for a predetermined time (0.075 second) was plotted to each light energy. This is referred to a photo-induced decay curve, an example of which is shown in FIG. 4.

$E_{95}$ indicates a light energy (light energy at the drop-off point of a photo-induced decay curve) to maintain a surface potential almost at the same level (95% surface potential) as the initial potential $V_0$ immediately after charging; $E_5$ indicates a light energy (light energy at the rising point of a photo-induced decay curve) to lower a surface potential to a residual potential $V_r$ level (5% surface potential) after irradiation of 50 $\mu$J/cm$^2$; and a $E_5/E_{95}$ value was made as a measure for judging "digital-recordable" on the basis of the following evaluation standard.

$0<E_5/E_{95}\leqq 5$: digital-recordable $5<E_{95}/E_5$: analog-recording

In the range of $0<E_5/E_{95}\leqq 5$, a photosensitivity becomes better as a $E_{95}$ value becomes smaller, and a more satisfactory electrophotographic photoreceptor can be provided. The evaluation results are shown in the following Table 3.

TABLE 3

| | Photoreceptor properties | | | | |
|---|---|---|---|---|---|
| | $V_0$ (V) | $E_{95}$ ($\mu$J/cm$^2$) | $E_5$ ($\mu$J/cm$^2$) | $E_5/E_{95}$ | $V_r$ (V) |
| Example | | | | | |
| 1 | 570 | 0.5 | 2.3 | 4.6 | 40 |
| 2 | 550 | 0.3 | 1.2 | 4.0 | 10 |
| 3 | 580 | 0.2 | 0.7 | 3.5 | 15 |
| 4 | 550 | 0.3 | 1.2 | 4.0 | 10 |
| 5 | 590 | 0.2 | 0.6 | 3.0 | 15 |
| 6 | 550 | 0.3 | 1.2 | 4.0 | 10 |
| 7 | 590 | 0.2 | 0.7 | 3.5 | 20 |
| 8 | 560 | 0.3 | 1.1 | 3.7 | 10 |
| 9 | 590 | 0.2 | 0.6 | 3.0 | 15 |
| 10 | 560 | 0.3 | 1.2 | 4.0 | 10 |
| 11 | 600 | 0.2 | 0.6 | 3.0 | 15 |
| 12 | 580 | 0.2 | 0.5 | 2.5 | 10 |
| 13 | 550 | 0.2 | 0.4 | 2.0 | 10 |
| 14 | 530 | 0.2 | 0.3 | 1.5 | 5 |
| 15 | 600 | 0.2 | 0.5 | 2.5 | 10 |
| 16 | 600 | 0.2 | 0.4 | 2.0 | 10 |
| 17 | 600 | 0.2 | 0.3 | 1.5 | 10 |
| 18 | 580 | 0.2 | 0.5 | 2.5 | 10 |
| 19 | 580 | 0.2 | 0.5 | 2.5 | 10 |
| 20 | 600 | 0.2 | 0.6 | 3.0 | 15 |
| 21 | 580 | 0.2 | 0.3 | 1.5 | 10 |
| 22 | 590 | 0.2 | 0.3 | 1.5 | 10 |
| 23 | 590 | 0.2 | 0.3 | 1.5 | 10 |
| 24 | 590 | 0.2 | 0.3 | 1.5 | 10 |
| 25 | 600 | 0.2 | 0.4 | 2.0 | 15 |
| 26 | 600 | 0.2 | 0.4 | 2.0 | 15 |
| 27 | 580 | 0.2 | 0.9 | 4.5 | 30 |
| 28 | 580 | 0.2 | 0.6 | 3.0 | 15 |
| 29 | 590 | 0.2 | 0.5 | 2.5 | 15 |
| 30 | 600 | 0.2 | 0.4 | 2.0 | 15 |
| 31 | 600 | 0.2 | 0.8 | 4.0 | 25 |
| 32 | 600 | 0.2 | 0.8 | 4.0 | 25 |
| 33 | 600 | 0.2 | 0.3 | 1.5 | 10 |

TABLE 3-continued

| | Photoreceptor properties | | | | |
|---|---|---|---|---|---|
| | $V_0$ | $E_{95}$ | $E_5$ | $E_5/E_{95}$ | $V_r$ |
| | (V) | ($\mu$J/cm$^2$) | ($\mu$J/cm$^2$) | | (V) |
| 34 | 600 | 0.2 | 0.4 | 2.0 | 10 |
| 35 | 600 | 0.2 | 0.3 | 1.5 | 10 |
| 36 | 600 | 0.2 | 0.9 | 4.5 | 25 |
| 37 | 580 | 0.2 | 0.8 | 4.0 | 20 |
| 38 | 570 | 0.2 | 0.9 | 4.5 | 30 |
| 39 | 570 | 0.2 | 0.9 | 4.5 | 20 |
| 40 | 600 | 0.2 | 0.6 | 3.0 | 10 |
| 41 | 520 | 0.2 | 0.6 | 3.0 | 35 |
| Comparative Example | | | | | |
| 1 | 500 | 0.8 | 12.0 | 15 | 160 |
| 2 | 550 | 0.4 | 5.2 | 13 | 50 |
| 3 | 590 | 0.3 | 5.0 | 17 | 80 |
| 4 | 570 | 0.4 | 5.0 | 13 | 50 |
| 5 | 590 | 0.3 | 3.9 | 13 | 50 |
| 6 | 600 | 0.3 | 3.0 | 10 | 50 |
| 7 | 600 | 0.3 | 2.1 | 7 | 50 |
| 8 | 600 | 0.3 | 2.4 | 8 | 50 |
| 9 | 600 | 0.4 | 5.6 | 14 | 50 |

(Electrophotographic photoreceptor containing a compound having a carboxyl group)

Example 42

0.25 g of titanylphthalocyanine obtained in the Preparation Example 1 and 0.0125 g (1 wt %) of benzoic acid, together with 1.0 g of polycarbonate resin obtained in Preparation Example 4, 6.5 g of toluene and 12 g of glass beads (diameter 2 mm), were sealed in a glass container, and were dispersed by a paint shaker (manufactured by Red Devil Company) for four hours. After dispersion, the glass beads were separated to obtain a photosensitive material coating solution. The photosensitive material coating solution thus obtained was coated on a degreased aluminum sheet having thickness of 90 $\mu$m by wire bar method, and was preliminarily dried at room temperature and was dried in an oven at 100° C. for 1 hour to obtain an electrophotographic photoreceptor having a photosensitive layer thickness of 18 $\mu$m.

Examples 43 to 88

Electrophotographic photoreceptors were prepared in the same manner as in Example 42, except for using 0.25 g of titanylphthalocyanine (TiOPc), carboxylic acid compounds and 1.0 g of polycarbonate resins (PCR) as shown in the following Table 4.

TABLE 4

| Example | TiOPc | Hydroxyl group-containing compound (mg, wt %) | PCR |
|---|---|---|---|
| 43 | Preparation Example 2 | Benzoic acid (12.5, 1) | Preparation Example 4 |
| 44 | Preparation Example 3 | Benzoic acid (12.5, 1) | Preparation Example 4 |
| 45 | Preparation Example 2 | Benzoic acid (12.5, 1) | Preparation Example 5 |
| 46 | Preparation Example 3 | Benzoic acid (12.5, 1) | Preparation Example 5 |
| 47 | Preparation Example 2 | Benzoic acid (12.5, 1) | Preparation Example 6 |

TABLE 4-continued

| Example | TiOPc | Hydroxyl group-containing compound (mg, wt %) | PCR |
|---|---|---|---|
| 48 | Preparation Example 3 | Benzoic acid (12.5, 1) | Preparation Example 6 |
| 49 | Preparation Example 2 | Benzoic acid (12.5, 1) | Preparation Example 7 |
| 50 | Preparation Example 3 | Benzoic acid (12.5, 1) | Preparation Example 7 |
| 51 | Preparation Example 2 | Benzoic acid (12.5, 1) | Preparation Example 8 |
| 52 | Preparation Example 3 | Benzoic acid (12.5, 1) | Preparation Example 8 |
| 53 | Preparation Example 3 | Benzoic acid (37.5, 3) | Preparation Example 7 |
| 54 | Preparation Example 3 | Benzoic acid (87.5, 7) | Preparation Example 7 |
| 55 | Preparation Example 3 | Benzoic acid (150, 12) | Preparation Example 7 |
| 56 | Preparation Example 3 | Chlorobenzoic acid (12.5, 1) | Preparation Example 7 |
| 57 | Preparation Example 3 | Fluorobenzoic acid (12.5, 1) | Preparation Example 7 |
| 58 | Preparation Example 3 | Bromobenzoic acid (12.5, 1) | Preparation Example 7 |
| 59 | Preparation Example 3 | Trifluoromethylbenzoic acid (12.5, 1) | Preparation Example 7 |
| 60 | Preparation Example 3 | Nitrobenzoic acid (12.5, 1) | Preparation Example 7 |
| 61 | Preparation Example 3 | Aminobenzoic acid (12.5, 1) | Preparation Example 7 |
| 62 | Preparation Example 3 | Terephthalic acid (12.5, 1) | Preparation Example 7 |
| 63 | Preparation Example 3 | Isophthalic acid (12.5, 1) | Preparation Example 7 |
| 64 | Preparation Example 3 | Phthalic acid (12.5, 1) | Preparation Example 7 |
| 65 | Preparation Example 3 | Naphthalenic acid (12.5, 1) | Preparation Example 7 |
| 66 | Preparation Example 3 | Naphthalenedicarboxylic acid (12.5, 1) | Preparation Example 7 |
| 67 | Preparation Example 3 | Biphenylcarboxylic acid (12.5, 1) | Preparation Example 7 |
| 68 | Preparation Example 3 | Biphenyldicarboxylic acid (12.5, 1) | Preparation Example 7 |
| 69 | Preparation Example 3 | Anthracenecarboxylic acid (12.5, 1) | Preparation Example 7 |
| 70 | Preparation Example 3 | Phenylacetic acid (12.5, 1) | Preparation Example 7 |
| 71 | Preparation Example 3 | Methoxyphenylacetic acid (12.5, 1) | Preparation Example 7 |
| 72 | Preparation Example 3 | Cinnamic acid (12.5, 1) | Preparation Example 7 |
| 73 | Preparation Example 3 | Hydroxycinnamic acid (12.5, 1) | Preparation Example 7 |
| 74 | Preparation Example 3 | Heptanoic acid (12.5, 1) | Preparation Example 7 |
| 75 | Preparation Example 3 | Octanoic acid (12.5, 1) | Preparation Example 7 |
| 76 | Preparation Example 3 | Octanedicarboxylic acid (12.5, 1) | Preparation Example 7 |
| 77 | Preparation Example 3 | Nonanoic acid (12.5, 1) | Preparation Example 7 |
| 78 | Preparation Example 3 | Trimethylhexanoic acid (12.5, 1) | Preparation Example 7 |
| 79 | Preparation Example 3 | Decanoic acid (12.5, 1) | Preparation Example 7 |
| 80 | Preparation Example 3 | Decanedicarboxylic acid (12.5, 1) | Preparation Example 7 |
| 81 | Preparation Example 3 | Eicosanoic acid (12.5, 1) | Preparation Example 7 |
| 82 | Preparation Example 3 | Chlorobenzoic acid (12.5, 1) | Preparation Example 8 |
| 83 | Preparation Example 3 | Nitrobenzoic acid (12.5, 1) | Preparation Example 8 |
| 84 | Preparation Example 3 | Phthalic acid (12.5, 1) | Preparation Example 8 |

TABLE 4-continued

| Example | TiOPc | Hydroxyl group-containing compound (mg, wt %) | PCR |
|---|---|---|---|
| 85 | Preparation Example 3 | Naphthalenedicarboxylic acid (12.5, 1) | Preparation Example 8 |
| 86 | Preparation Example 3 | Anthracenecarboxylic acid (12.5, 1) | Preparation Example 8 |
| 87 | Preparation Example 3 | Anthracenecarboxylic acid (25, 2) | Preparation Example 8 |
| 88 | Preparation Example 3 | Benzoic acid (250, 20) | Preparation Example 7 |

Hereinafter, in order to evaluate a carboxyl group-containing compound of each Example of the present invention, the following Comparative Examples are illustrated.

Comparative Example 10

The same procedure as in Example 1 was repeated, except that 0.25 g of titanylphthalocyanine obtained in Preparation Example 3, 1.0 g of polycarbonate resin obtained in Preparation Example 7 and 12.5 mg (1 wt %) of ethyl benzoate as an ester compound in place of a carboxyl group-containing compound, were used. Evaluation results of electrophotographic photoreceptors of Examples 42 to 88 and Comparative Example 10 are shown in the following Table 5.

TABLE 5

| | Photoreceptor properties | | | | |
|---|---|---|---|---|---|
| | $V_0$ (V) | $E_{95}$ ($\mu J/cm^2$) | $E_5$ ($\mu J/cm^2$) | $E_5/E_{95}$ | $V_r$ (V) |
| Example | | | | | |
| 42 | 570 | 0.4 | 1.8 | 4.5 | 35 |
| 43 | 590 | 0.3 | 1.2 | 4.0 | 15 |
| 44 | 580 | 0.2 | 0.7 | 3.5 | 15 |
| 45 | 600 | 0.3 | 1.2 | 4.0 | 10 |
| 46 | 590 | 0.2 | 0.7 | 3.5 | 10 |
| 47 | 590 | 0.3 | 1.3 | 4.3 | 25 |
| 48 | 600 | 0.2 | 0.8 | 4.0 | 25 |
| 49 | 600 | 0.3 | 1.0 | 3.3 | 10 |
| 50 | 600 | 0.2 | 0.6 | 3.0 | 10 |
| 51 | 600 | 0.3 | 1.1 | 3.7 | 10 |
| 52 | 600 | 0.2 | 0.6 | 3.0 | 15 |
| 53 | 580 | 0.2 | 0.5 | 2.5 | 10 |
| 54 | 560 | 0.2 | 0.4 | 2.0 | 10 |
| 55 | 540 | 0.2 | 0.3 | 1.5 | 5 |
| 56 | 600 | 0.2 | 0.5 | 2.5 | 15 |
| 57 | 600 | 0.2 | 0.5 | 2.5 | 20 |
| 58 | 600 | 0.2 | 0.5 | 2.5 | 25 |
| 59 | 580 | 0.2 | 0.4 | 2.0 | 20 |
| 60 | 580 | 0.2 | 0.4 | 2.0 | 15 |
| 61 | 600 | 0.4 | 1.8 | 4.5 | 40 |
| 62 | 600 | 0.2 | 0.6 | 3.0 | 15 |
| 63 | 590 | 0.2 | 0.5 | 2.5 | 10 |
| 64 | 600 | 0.4 | 1.8 | 4.5 | 50 |
| 65 | 600 | 0.2 | 0.6 | 3.0 | 25 |
| 66 | 580 | 0.2 | 0.5 | 2.5 | 20 |
| 67 | 600 | 0.2 | 0.6 | 3.0 | 25 |
| 68 | 580 | 0.2 | 0.5 | 2.5 | 20 |
| 69 | 600 | 0.2 | 0.6 | 3.0 | 25 |
| 70 | 580 | 0.2 | 0.8 | 4.0 | 40 |
| 71 | 600 | 0.2 | 0.6 | 3.0 | 25 |
| 72 | 600 | 0.2 | 0.8 | 4.0 | 40 |
| 73 | 600 | 0.2 | 0.6 | 3.0 | 25 |
| 74 | 600 | 0.2 | 0.6 | 3.0 | 20 |
| 75 | 600 | 0.2 | 0.6 | 3.0 | 20 |
| 76 | 580 | 0.2 | 0.5 | 2.5 | 15 |

TABLE 5-continued

| | Photoreceptor properties | | | | |
|---|---|---|---|---|---|
| | $V_0$ (V) | $E_{95}$ ($\mu J/cm^2$) | $E_5$ ($\mu J/cm^2$) | $E_5/E_{95}$ | $V_r$ (V) |
| 77 | 600 | 0.2 | 0.6 | 3.0 | 15 |
| 78 | 600 | 0.2 | 0.6 | 3.0 | 15 |
| 79 | 600 | 0.2 | 0.6 | 3.0 | 15 |
| 80 | 600 | 0.2 | 0.5 | 2.5 | 25 |
| 81 | 600 | 0.4 | 1.8 | 4.5 | 35 |
| 82 | 600 | 0.2 | 0.6 | 3.0 | 20 |
| 83 | 580 | 0.2 | 0.5 | 2.5 | 15 |
| 84 | 600 | 0.2 | 0.6 | 3.0 | 15 |
| 85 | 570 | 0.2 | 0.5 | 2.5 | 10 |
| 86 | 600 | 0.2 | 0.6 | 3.0 | 20 |
| 87 | 580 | 0.2 | 0.5 | 2.5 | 25 |
| 88 | 540 | 0.2 | 0.4 | 2.0 | 25 |
| Comparative Example | | | | | |
| 10 | 600 | 0.4 | 5.2 | 13 | 50 |

(Electrophotographic photoreceptor containing a resin having an acid value of from 1 to 50 mgKOH/g)

Example 89

0.25 g of β type titanylphthalocyanine obtained in Preparation Example 1, 0.9 g of polycarbonate obtained in Preparation Example 4, 0.1 g of resin having an acid value of 35.4 mgKOH/g obtained in Preparation Example 9, 6.5 g of toluene and 12 g of glass beads (diameter 2 mm) were sealed in a glass container, and were dispersed by a paint shaker (manufactured by Red Devil Company) for 4 hours. After dispersion, the glass beads were separated to obtain a photosensitive material coating solution. The photosensitive material coating solution was coated on a degreased aluminum sheet having a thickness of 90 μm by wire bar method, and was preliminarily dried at room temperature and was further dried in an oven at 100° C. for 1 hour to obtain an electrophotographic photoreceptor. At this time, the photosensitive layer had a thickness of 18 μm.

Examples 90 to 108

Electrophotographic photoreceptors were prepared in the same manner as in Example 89, except that 0.25 g of titanylphthalocyanine (TiOPc), resins having various acid values and polycarbonate resins (PCR) as shown in the following Table 6, were used.

TABLE 6

| Example | TiOPc | Resin having acid value (g, wt %) (Acid value mgKOH/g) | PCR (g, wt %) |
|---|---|---|---|
| 90 | Preparation Example 2 | Preparation Example 9 (0.1, 10) (35.4) | Preparation Example 4 (0.9, 90) |
| 91 | Preparation Example 3 | Preparation Example 9 (0.1, 10) (35.4) | Preparation Example 4 (0.9, 90) |
| 92 | Preparation Example 2 | Preparation Example 10 (0.1, 10) (38.1) | Preparation Example 5 (0.9, 90) |
| 93 | Preparation Example 3 | Preparation Example 10 (0.1, 10) (38.1) | Preparation Example 5 (0.9, 90) |

TABLE 6-continued

| Example | TiOPc | Resin having acid value (g, wt %) (Acid value mgKOH/g) | PCR (g, wt %) |
|---|---|---|---|
| 94 | Preparation Example 2 | Preparation Example 10 (0.1, 10) (38.1) | Preparation Example 6 (0.9, 90) |
| 95 | Preparation Example 3 | Preparation Example 10 (0.1, 10) (38.1) | Preparation Example 6 (0.9, 90) |
| 96 | Preparation Example 2 | Preparation Example 10 (0.1, 10) (38.1) | Preparation Example 7 (0.9, 90) |
| 97 | Preparation Example 3 | Preparation Example 10 (0.1, 10) (38.1) | Preparation Example 7 (0.9, 90) |
| 98 | Preparation Example 2 | Preparation Example 10 (0.1, 10) (38.1) | Preparation Example 8 (0.9, 90) |
| 99 | Preparation Example 3 | Preparation Example 10 (0.1, 10) (38.1) | Preparation Example 8 (0.9, 90) |
| 100 | Preparation Example 3 | Preparation Example 11 (0.1, 10) (40.3) | Preparation Example 7 (0.9, 90) |
| 101 | Preparation Example 3 | Preparation Example 12 (0.1, 10) (35.9) | Preparation Example 7 (0.9, 90) |
| 102 | Preparation Example 3 | Preparation Example 13 (0.1, 10) (4.3) | Preparation Example 7 (0.9, 90) |
| 103 | Preparation Example 3 | Preparation Example 14 (0.1, 10) (20.2) | Preparation Example 7 (0.9, 90) |
| 104 | Preparation Example 3 | Preparation Example 15 (0.1, 10) (37.8) | Preparation Example 7 (0.9, 90) |
| 105 | Preparation Example 3 | Preparation Example 16 (0.1, 10) (25.4) | Preparation Example 7 (0.9, 90) |
| 106 | Preparation Example 3 | Preparation Example 10 (0.05, 5) (38.1) | Preparation Example 7 (0.95, 95) |
| 107 | Preparation Example 3 | Preparation Example 10 (0.2, 20) (38.1) | Preparation Example 7 (0.8, 80) |
| 108 | Preparation Example 3 | Preparation Example 10 (0.3, 30) (38.1) | Preparation Example 7 (0.7, 70) |

Example 109

0.25 g of titanylphthalocyanine obtained in Preparation Example 3, 0.9 g of polycarbonate resin obtained in Preparation Example 7, 0.1 g of "Cefralcoat.A202B" (manufactured by Central Glass Company, acid value: 3 mgKOH/g), 6.5 g of toluene and 12 g of glass beads (diameter 2 mm) were sealed in a glass container, and were dispersed by a paint shaker (manufactured by Red Devil Company) for 4 hours. After dispersion, the glass beads were separated to obtain a photosensitive material coating solution. The photosensitive material coating solution thus obtained was coated on a degreased aluminum sheet having a thickness of 90 $\mu$m by wire bar method, and was preliminarily dried at room temperature and was dried in an oven at 100° C. for 1 hour to obtain an electrophotographic photoreceptor. The photosensitive layer thus obtained had a thickness of 18 βm.

Example 110

An electrophotographic photoreceptor was prepared in the same manner as in Example 109, except that the amount of polycarbonate resin was changed to 0.8 g, and the amount of "Cefralcoat.A202B" (manufactured by Central Glass Company, acid value: 3 mgKOH/g) was changed to 0.2 g.

Hereinafter, in order to evaluate a resin having an acid value of each Example of the present invention, the following Comparative Examples are illustrated.

Comparative Examples 11 to 13

Comparative electrophotographic photoreceptors were prepared in the same manner as in Example 1, except that 0.25 g of titanylphthalocyanine obtained in Preparation Example 3, 0.9 g of polycarbonate resin obtained in Preparation Example 7 and 0.1 g of each of Comparative Preparation Examples 1 to 3 were used, and the conditions are shown in the following Table 7. Further, electrophotographic photoreceptors of Example 89 to 110 and Comparative Examples 11 to 13 were subjected to evaluation tests, and the results are shown in the following Table 8.

TABLE 7

| Comparative Example | TiOPc | Resin having acid value (g, wt %) (Acid value mgKOH/g) | PCR (g, wt %) |
|---|---|---|---|
| 11 | Preparation Example 3 | Comparative Preparation Example 1 (0.1, 10) (0) | Preparation Example 7 (0.9, 90) |
| 12 | Preparation Example 3 | Comparative Preparation Example 2 (0.1, 10) (72) | Preparation Example 7 (0.9, 90) |
| 13 | Preparation Example 3 | Comparative Preparation Example 3 (0.1, 10) (215.6) | Preparation Example 7 (0.9, 90) |

TABLE 8

| | Photoreceptor properties | | | | |
|---|---|---|---|---|---|
| | $V_0$ (V) | $E_{95}$ ($\mu$J/cm$^2$) | $E_5$ ($\mu$J/cm$^2$) | $E_5/E_{95}$ | $V_r$ (V) |
| Example | | | | | |
| 89 | 560 | 0.5 | 2.4 | 4.8 | 50 |
| 90 | 550 | 0.4 | 1.8 | 5.4 | 10 |
| 91 | 570 | 0.3 | 1.2 | 4.0 | 10 |
| 92 | 580 | 0.3 | 1.2 | 4.0 | 10 |
| 93 | 600 | 0.2 | 0.6 | 3.0 | 15 |
| 94 | 570 | 0.3 | 1.2 | 4.0 | 10 |
| 95 | 600 | 0.2 | 0.6 | 3.0 | 15 |
| 96 | 570 | 0.3 | 1.2 | 4.0 | 10 |
| 97 | 590 | 0.2 | 0.5 | 2.5 | 10 |
| 98 | 580 | 0.3 | 1.2 | 4.0 | 10 |
| 99 | 600 | 0.2 | 0.5 | 2.5 | 10 |
| 100 | 600 | 0.2 | 0.7 | 3.5 | 20 |
| 101 | 600 | 0.2 | 0.8 | 4.0 | 30 |
| 102 | 600 | 0.2 | 0.9 | 4.5 | 30 |
| 103 | 600 | 0.2 | 0.8 | 4.0 | 25 |
| 104 | 570 | 0.2 | 0.6 | 3.0 | 15 |
| 105 | 600 | 0.2 | 0.6 | 3.0 | 15 |
| 106 | 600 | 0.2 | 0.7 | 3.5 | 10 |
| 107 | 560 | 0.2 | 0.4 | 2.0 | 5 |
| 108 | 550 | 0.2 | 0.3 | 1.5 | 5 |
| 109 | 600 | 0.2 | 0.4 | 2.0 | 5 |
| 110 | 600 | 0.2 | 0.3 | 1.5 | 5 |
| Comparative Example | | | | | |
| 11 | 600 | 0.4 | 6.0 | 15 | 120 |
| 12 | 150 | 0.2 | 0.5 | 2.5 | 5 |
| 13 | 70 | — | — | — | — |

With regard to Comparative Example 13, a photo-induced decay or a surface potential was not recognized, and a value other than $V_0$ could not be measured.

As described above, an electrophotographic photoreceptor of the present invention obtained by dispersing titanylphthalocyanine in a photosensitive layer comprising a polycarbonate resin containing at least one of a carboxylic acid-containing compound, a hydroxyl group-containing compound and a resin having an acid value of from 1 to 50 mgKOH/g, provides a unique property in the way of flowing photoelectric current to light input, or can output as a digital signal in either case of analog light or digital light. Thus, the electrophotographic photoreceptor of the present invention can be used not only for digital recording but also for conventional PPC (analog light input) to produce high quality images having sharp edges.

We claim:

1. An electrophotographic photoreceptor for digital light input, having a threshold value in its photo-induced decay curve and having a photosensitive layer of titanylphthalocyanine dispersed in a binder resin provided on an electroconductive substrate, wherein the binder resin in which said titanylphthalocyanine is dispersed is a polycarbonate resin and wherein said photosensitive layer contains a compound having a carboxyl group.

2. The electrophotographic photoreceptor according to claim 1, wherein the compound having a carboxyl group is a $C_6$–$C_{30}$ aromatic carboxylic acid compound or a $C_6$–$C_{20}$ aliphatic carboxylic acid compound.

3. The electrophotographic photoreceptor according to claim 1, wherein the compound having a carboxyl group is contained in an amount of from 0.001 to 20 wt % to the total solid content in the photoreceptor.

4. The electrophotographic photoreceptor according to claim 1, wherein the titanylphthalocyanine is a crystalline titanylphthalocyanine having diffraction peaks at Bragg angles (2θ±0.2°) of 9.5°, 24.1° and 27.3° in its X-ray diffraction spectrum, among which the diffraction peak at 27.3° is the strongest.

5. An electrophotographic photoreceptor having a photosensitive layer of titanylphthalocyanine dispersed in a binder resin provided on an electroconductive substrate, wherein the binder resin is a mixture of a polycarbonate resin and a resin having an acid value of from 1 to 50 mgKOH/g.

6. The electrophotographic photoreceptor according to claim 5, wherein the electrophotographic photoreceptor has a threshold value in its photo-induced decay curve and is used for digital light input.

7. The electrophotographic photoreceptor according to claim 5, wherein the amount of the resin having an acid value of from 1 to 50 mgKOH/g is from 5 to 30 wt % to the polycarbonate resin.

8. The electrophotographic photoreceptor according to claim 5, wherein the titanylphthalocyanine is a titanylphthalocyanine having diffraction peaks at Bragg angles (2θ±0.2°) of 9.5°, 24.1° and 27.3° in its X-ray diffraction spectrum, among which the diffraction peak at 27.3° is the strongest.

9. An electrophotographic photoreceptor for digital light input, having a threshold value in its photo-induced decay curve and having a photosensitive layer of titanylphthalocyanine dispersed in a binder resin provided on an electroconductive substrate, wherein the binder resin is a polycarbonate resin and the binder resin contains a compound having a hydroxyl group.

10. The electrophotographic photoreceptor according to claim 9, wherein the compound having a hydroxyl group is a hydroxyl group-containing $C_6$–$C_{30}$ aromatic compound or a hydroxyl group-containing $C_6$–$C_{20}$ aliphatic compound.

11. The electrophotographic photoreceptor according to claim 9, the compound having a hydroxyl group is contained in an amount of from 0.001 to 20 wt % to the total solid content in the photoreceptor.

12. The electrophotographic photoreceptor according to claim 9, wherein the titanylphthalocyanine is a crystalline titanylphthalocyanine having diffraction peaks at Bragg angles (2θ±0.2°) of 9.5°, 24.1° and 27.3° in its X-ray diffraction spectrum, among which the diffraction peak at 27.3° is the strongest.

13. The electrophotographic photoreceptor of claim 2 wherein said compound having a carboxyl group is benzoic acid.

14. The electrophotographic photoreceptor of claim 2 wherein said compound having a carboxyl group is a halogenated benzoic acid.

15. The electrophotographic photoreceptor of claim 9 wherein said compound having a hydroxyl group is a halophenol.

16. The electrophotographic photoreceptor of claim 15 wherein said halophenol is bromophenol.

* * * * *